US008565659B2

(12) United States Patent
Cardoso et al.

(10) Patent No.: US 8,565,659 B2
(45) Date of Patent: Oct. 22, 2013

(54) FUSER MEMBER AND METHOD OF MANUFACTURE

(75) Inventors: George C. Cardoso, Webster, NY (US); Pinyen Lin, Rochester, NY (US); Anthony S. Condello, Webster, NY (US); Jason M. LeFevre, Penfield, NY (US); Richard W. Seyfried, Williamson, NY (US); Grace T. Brewington, Fairport, NY (US); Christopher G. Lynn, Wolcott, NY (US); Dale R. Mashtare, Simpsonville, SC (US); James R. Beachner, Ontario, NY (US); Daniel Bray, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 336 days.

(21) Appl. No.: 12/968,622

(22) Filed: Dec. 15, 2010

(65) Prior Publication Data

US 2012/0155919 A1 Jun. 21, 2012

(51) Int. Cl.
*G03G 15/20* (2006.01)

(52) U.S. Cl.
USPC ..... 399/333

(58) Field of Classification Search
USPC ..... 399/122, 320, 328–333; 29/895.21, 29/895.32; 492/30, 31, 54
See application file for complete search history.

(56) References Cited

U.S. PATENT DOCUMENTS 4,518,468 A * 5/1985 Fotland et al. ..... 205/204
6,007,657 A * 12/1999 Eddy et al. ..... 156/184

* cited by examiner

*Primary Examiner* — Hoan Tran
(74) *Attorney, Agent, or Firm* — Hoffman Warnick LLC

(57) ABSTRACT

There is described a fuser roller including a surface layer of anodized aluminum oxide impregnated with a fluorine containing sealant. There is also described the method for producing the fuser member.

17 Claims, 3 Drawing Sheets

FUSER MEMBER AND METHOD OF MANUFACTURE

BACKGROUND

1. Field of Use

This disclosure is generally directed to fuser members useful in electrophotographic imaging apparatuses, including digital, image on image, and the like. This disclosure also relates to processes for making and using fuser members.

2. Background

Generally, in a commercial electrophotographic marking or reproduction apparatus (such as copier/duplicators, printers, multifunctional systems or the like), a latent image charge pattern is formed on a uniformly charged photoconductive or dielectric member. Pigmented marking particles (toner) are attracted to the latent image charge pattern to develop this image on the photoconductive or dielectric member. A receiver member, such as paper, is then brought into contact with the dielectric or photoconductive member and an electric field applied to transfer the marking particle developed image to the receiver member from the photoconductive or dielectric member. After transfer, the receiver member bearing the transferred image is transported away from the dielectric member to a fusion station and the image is fixed or fused to the receiver member by heat and/or pressure to form a permanent reproduction thereon. The receiving member passes between a pressure roller and a heated fuser roller or element.

Life of a typical fuser roller is less than the machine life which makes it inevitable that a number of fuser rollers will be changed over the life of a machine. Since the fuser is typically the most expensive CRU (Customer Replaceable Unit) within the marking engine it results in a significant increase in the total cost of ownership. Therefore, it is very desirable to design and manufacture a fuser roller that can have a lifespan equal to or longer than the life of the machine.

SUMMARY

According to an embodiment, there is described a fuser roller comprising a surface layer comprising anodized aluminum oxide impregnated with a fluorine containing sealant.

According to an embodiment, there is described a method for producing a fuser member. The method includes obtaining a substrate having an outer aluminum surface and anodizing the outer aluminum surface to create an aluminum oxide surface containing pores. The pores are impregnated with a material selected from the group consisting of nickel fluoride and polytetrafluoroethylene.

According to an embodiment, there is described an image forming apparatus for forming images on a recording medium. The apparatus comprises a charge-retentive surface to receive an electrostatic latent image thereon; a development component to apply toner to the charge-retentive surface to develop an electrostatic latent image to form a developed image on the charge retentive surface; a transfer component to transfer the developed image from the charge retentive surface to a copy substrate; and a fuser member for fusing toner images to a surface of the copy substrate. The fuser member comprises a surface layer comprising anodized aluminum oxide impregnated with a sealant selected from the group consisting of nickel fluoride and polytetrafluoroethylene.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the drawings have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Figure 1:
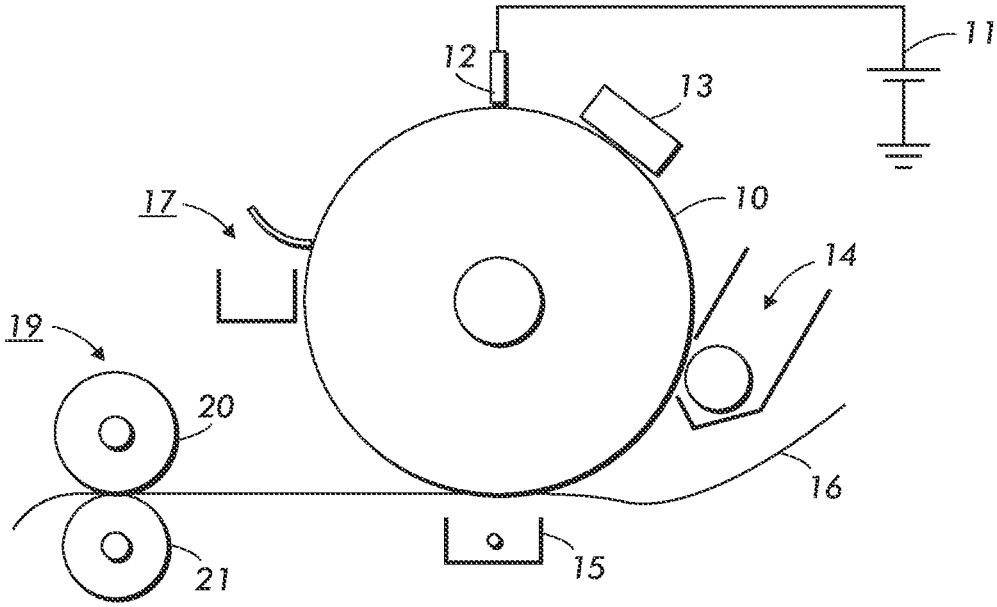
FIG. 1 is an illustration of a general electrophotographic apparatus.

Referring to FIG. 1, in a typical electrophotographic reproducing apparatus, a light image of an original to be copied is recorded in the form of an electrostatic latent image upon a photosensitive member and the latent image is subsequently rendered visible by the application of electrically charged thermoplastic resin particles which are commonly referred to as toner. Specifically, photoreceptor 10 is charged on its surface by means of a charger 12 to which a voltage has been supplied from power supply 11. The photoreceptor 10 is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rollers, wherein the developed image is fused to copy sheet 16 by passing copy sheet 16 between the fusing member 20 and pressure member 21, thereby forming a permanent image. Subsequent to transfer, photoreceptor 10 advances to cleaning station 17, wherein any toner left on photoreceptor 10 is cleaned therefrom by use of a blade (as shown in FIG. 1), brush, or other cleaning apparatus.

Figure 2:
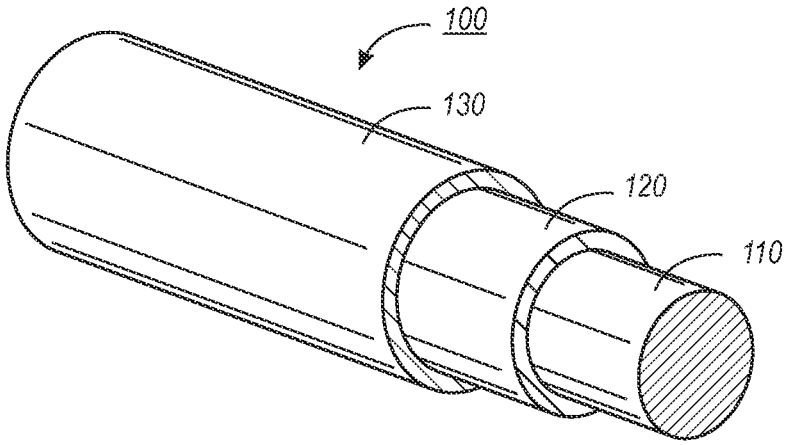
FIG. 2 (Prior Art)
FIG. 2 is a sectional view of a prior art fuser roller having a three-layer configuration.

FIG. 2 is an enlarged schematic view of an embodiment of a prior art fuser member 100, demonstrating the various possible layers. As shown in FIG. 2, substrate 110 has intermediate layer 120 thereon. The substrate 110 is typically a metal such as aluminum, nickel or stainless steel. The substrate 110 can be hollow or solid. Intermediate layer 120 can be, for example, a rubber such as silicone rubber or other suitable rubber material. On intermediate layer 120 is positioned outer layer 130, comprising a polymer, typically a fluoropolymer.

In a fuser member, as shown in FIG. 2, the intermediate layer 120 and the outer layer 130 have a combined thickness of greater than 250 microns. The intermediate layer 120 and outer layer 130 act as a thermal barrier requiring the fuser roller to operate at relatively high temperatures to fuse the toner. The typical operating temperature of a fuser member of this type is from about 180° C. to about 220° C. The higher the operating temperature, the more energy required to operate the device. Higher operating temperatures in electrophotographic machines reduce the lifetime of related components, such as pressure rollers. In addition, fuser rollers having a fluoropolymer outer surface wear out requiring periodic replacement.

Figure 3:
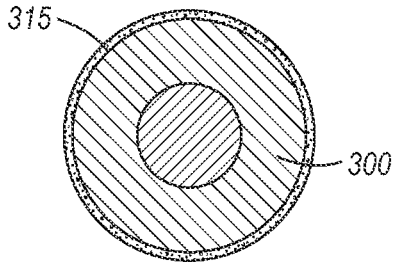
FIG. 3 is a cross-sectional view of an embodiment of a fuser roller having a anodized aluminum surface impregnated with a sealant.

The fuser roller disclosed herein mitigates the problems noted above. Shown in FIG. 3 is an embodiment, in cross-sectional view, of a fuser roller. The fuser roller is composed of an aluminum core 300 having a surface layer 315 of anodized aluminum oxide impregnated with a sealant selected from the group consisting of nickel fluoride, polytetrafluoroethylene or similar material. In embodiments the thickness of the surface layer 315 is from about 5 microns to 50 microns, or from about 10 microns to about 40 microns or from about 15 microns to about 30 microns.

Figure 4:
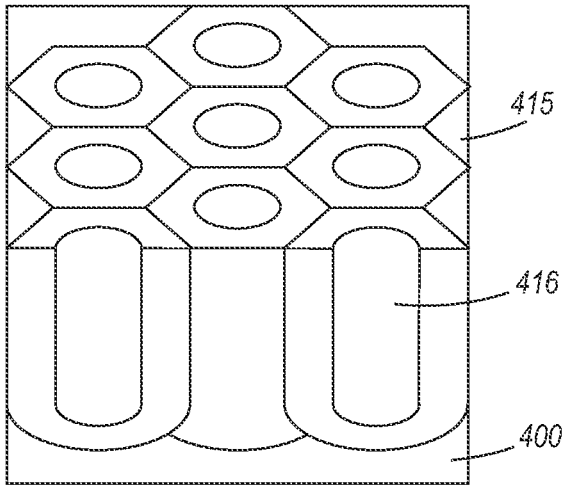
FIG. 4 is an expanded view of the surface of a fuser roller having a anodized aluminum surface impregnated with a sealant.

FIG. 4 shows an expanded view, not to scale, of the surface layer 315 of FIG. 3. The base material 400 is the aluminum of the aluminum core 300 (FIG. 3). The surface layer 315 is composed of anodized aluminum 415 having pores 416. The pores 416 have a surface density of from about 250 billion to about 500 billion per square inch. The sealant is coated on anodized aluminum having pores 416. The sealant is a fluorine containing compound. Examples of suitable sealants are nickel fluoride and polytetrafluoroethylene. The sealant impregnates the pores and provides the surface layer with suitable properties for a fuser roller. The hardness of the surface layer 315 is between 7 and 9 using the Mohs scale, or between 60 and 70 using the Rockwell C scale.

The surface layer 315 resists corrosion having withstood more the 13,000 hours of exposure in salt-spray tests as described in Federal Specification QQ-M-151a. The surface layer 315 shows superior wear resistance when compared to case hardened steel.

Figure 5:
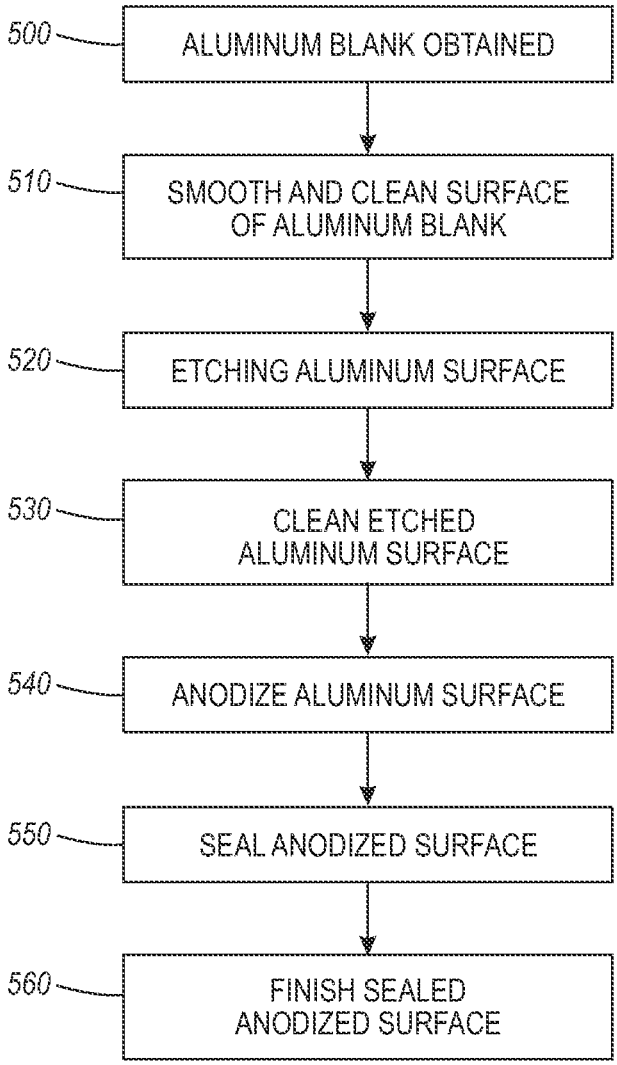
FIG. 5 is a flowchart of a method used to produce an anodized aluminum oxide impregnated with a sealant surface on a fuser roller.

The process for manufacturing the fuser member disclosed herein is shown schematically in FIG. 5. An aluminum tube of the proper size is obtained in step 500. The aluminum blank can be a tube or a solid cylinder. In step 510, the surface of the aluminum tube is polished to a roughness of about 5 to about 35 micro-inches. The process described has the effect of roughening the surface. If a roll is polished to first roughness before processing, the same roll will have a higher roughness after processing. Thus, an additional polishing step may be required to achieve the proper surface smoothness. Also in step 510 the surface is cleaned of residues and oils. The cleaning can be accomplished through heating and use of an alkaline cleaner. The surface is then roughened through an etching process in step 520. The etching process creates pits on the surface of the aluminum blank. The pits extend to a depth of from about 5 microns to about 100 microns, or from about 20 microns to about 80 microns or from about 20 to about 50 microns. The surface is cleaned with an acid wash to remove residues, also referred to as smut, resulting from the etching process in step 530. The surface is then anodized, which is an oxidation process in step 540. The anodization of the surface can be accomplished by immersion in heated sulfuric acid or from about 25° C. to about 200° C. with an applied current. This creates an aluminum oxide layer to a depth of from about 5 microns to about 100 microns, or from about 20 microns to about 80 microns or from about 20 to about 50 microns. Pores develop in the acid bath and provide a good base for the subsequent sealing step. The pores have a surface density of from about 250 billion to about 500 billion per square inch. Compared with the initial etching step 530, the pores produced in the anodization step 550 are very small and provide a base for the sealing step. The sealing step 550 impregnates the pores with a sealant. The sealant is a fluorine-containing compound. Examples of suitable sealants are nickel fluoride and polytetrafluoroethylene. The sealant impregnates in the pores of the aluminum as the surface cools from the annodization process. After the sealing step, the roller is finished or polished to the desired roughness of from about 5 to about 35 micro-inches in step 560. The thickness of the aluminum oxide layer having the impregnated fluoride sealant is typically from about 5 microns to about 100 microns, or from about 20 microns to about 80 microns or from about 20 to about 50 microns.

The fuser roller having a surface layer of anodized aluminum oxide impregnated with a sealant can be operated at temperatures of from about 110° C. to about 150° C., or from about 115° C. to about 140° C., or from about 120° C. to about 130° C. Compared to the fuser roller of FIG. 2, this reduces energy consumption and wear on the parts. The pressure at the nip of the fusing station 19 between the fuser roller 20 and the pressure roller 21 (see FIG. 1) is from about 200 psi to about 800 psi. The fuser roller disclosed herein has a surface roughness of less than about 600 nm Ra, or less than about 500 nm Ra or less than about 300 nm Ra. The surface layer has an electrical surface resistivity of less than about $10^{14}$ Ω/sq, or less than about $10^{10}$ Ω/sq or less than about $10^{8}$ Ω/sq.

Currently, the process described above is provided by companies such as Pioneer Metals and Altefco.

An oil can be applied to the surface layer. The oil can be a silicone oil and can contain a mixture of a mercapto functionalized silicone oil compound in an effective amount, for example, from about 0.1 to about 30 percent by weight and a second non-mercapto functionalized oil, such as polydimethyl silicone oil in an effective amount of, for example, about 99.9 to about 70 percent by weight. The second polydimethyl silicone oil compound can be selected from the group consisting of known non-functional silicone oils including an amino functional siloxane, phenyl methyl siloxane, trifluoropropyl functional siloxane, and a non functional silicone oil or polydimethylsiloxane oil. The functional oil is described more fully in U.S. Pat. No. 5,395,725, incorporated in its entirety by reference herein.

Another distinct advantage of aluminum oxide impregnated coating is that it is very hard and scratch resistant. Four million prints from a fuser roller disclosed herein are typical. The fuser member described herein can last the lifetime of a machine.

As noted previously, the fuser roller temperature can be reduced with the fuser roller having an anodized aluminum oxide impregnated with a sealant surface due to higher thermal conductivity. Using a fuser roller having a surface of anodized aluminum oxide impregnated with a sealant decrease the operating temperature of the fuser roller by about 70° C. A 70° C. decrease in run temperature is advantageous in that the fuser roller will have a decrease in failure rates and a decrease in power consumption.

Finally, the drop in fuser temperature opens the door for materials such as polyurethane for a pressure roller. This will reduce cost and increase life for the pressure rollers.

EXAMPLES

Warm pressure fuser test fixtures were designed and built to test the fuser roller having the aluminum oxide impregnated with a fluorine containing sealant. The fuser rollers were surface treated and impregnated with Teflon as described above by Webex Inc. Neenah Wis. A summary of the characteristics of the rollers tested are in Table 1. The fuser rolls having an anodized aluminum surface with pores impregnated with an polytetrafluoroethylene provided a performance equal to Teflon coated rolls having a silicon cushioning layer. There were no issues with degradation of performance.

TABLE 1

| (Fuser Roller (Al3O2 coated) | Coating description | Ra (nm) | Ω/□ Surface @400 V | Ω/□ Surface @1 kV | Ω to core @300 V |
|---|---|---|---|---|---|
| A1 | (PTFE), 6 microns | 285 | 1.22E+09 | 2.42E+08 | 5.14E+08 |
| B1 | (PTFE), 6 microns | 232 | 2.96E+09 | 5.87E+08 | 1.12E+09 |
| B2 | (PTFE), 6 microns | 248 | 3.21E+09 | 1.77E+08 | 1.75E+08 |

The rolls A1, B1 and B2 gave good performance for the fuser, there was no toner offset. Acceptable results were achieved for fuser roller having a surface Ra of less than 600 nm, results improved if the surface Ra was under 300 nm. The performance of the rolls is not very sensitive to the rolls' resistivity as long as the resistance is in the right order of magnitude.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A fuser member comprising:

a surface layer comprising anodized aluminum oxide having pores impregnated with a fluorine containing sealant wherein the pores have a surface density of from about 250 billion to about 500 billion per square inch.

2. The fuser member of claim 1 wherein the surface layer comprises a thickness of from about 5 to about 50 microns.

3. The fuser member of claim 1 wherein the surface layer comprises a surface roughness of less than 600 nm Ra.

4. The fuser member of claim 1 wherein the surface layer comprises a surface resistivity of from less than about $10^{13}$ Ω/square.

5. The fuser member of claim 1 wherein the fluorine containing sealant is selected from the group consisting of nickel fluoride and polytetrafluoroethylene.

6. The fuser member of claim 1 further comprising a functional silicone oil disposed on the surface layer.

7. The fuser member of claim 1 further comprising:

an aluminum core.

8. A method for the producing a fuser member comprising:

obtaining a substrate having an outer aluminum surface;

anodizing the outer aluminum surface comprising immersion of the substrate in sulfuric acid and application of an DC current to create an aluminum oxide surface containing pores; and impregnating the pores with a material selected from the group consisting of nickel fluoride and polytetrafluoroethylene.

9. The method of claim 8 further comprising:

polishing the coated surface to a surface roughness of from about 5 micro-inches to about 35 micro-inches.

10. The method of claim 8 further comprising:

etching the outer aluminum surface; and cleaning the etched surface prior to anodizing.

11. The method of claim 10 wherein etching the outer aluminum surface creates pits to a depth of about 5 microns to about 100 microns.

12. The method of claim 8 wherein the immersion of the substrate having an aluminum surface is at a temperature of from about 25° C. to about 200° C.

13. The method of claim 8 wherein the aluminum oxide surface comprises a thickness of about 5 microns to about 100 microns.

14. The method of claim 8 wherein the pores have a surface density of from about 250 billion to about 500 billion per square inch.

15. An image-forming apparatus for forming images on a recording medium comprising a charge-retentive surface to receive an electrostatic latent image thereon; a development component to apply toner to the charge-retentive surface to develop an electrostatic latent image to form a developed image on the charge retentive surface; a transfer component to transfer the developed image from the charge retentive surface to a copy substrate; and a fuser member for fusing toner images to a surface of the copy substrate, wherein said fuser member comprises a surface layer comprising anodized aluminum oxide impregnated with a sealant selected from the group consisting of nickel fluoride and polytetrafluoroethylene wherein the surface layer comprises a surface roughness of less than 600 nm Ra.

16. The image forming apparatus of claim 15 wherein the surface layer comprises a thickness of from about 5 microns to about 100 microns.

17. The image forming apparatus of claim 15 wherein the surface layer comprises a surface resistivity of less than about $10^{13}$ Ω/square.

* * * * *